US006336826B1

(12) United States Patent
Kraft

(10) Patent No.: US 6,336,826 B1
(45) Date of Patent: Jan. 8, 2002

(54) COMMUNICATIONS CABLING SYSTEM WITH TWISTED WIRE PAIRS

(75) Inventor: James L. Kraft, York, PA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/213,570

(22) Filed: Dec. 17, 1998

(51) Int. Cl.[7] ..... H01R 12/24

(52) U.S. Cl. ..... 439/498; 439/502; 439/941

(58) Field of Search ..... 439/502, 497, 439/108, 676, 941, 498; 174/115, 113 R

(56) References Cited

U.S. PATENT DOCUMENTS

| | | | | |
|---|---|---|---|---|
| 3,667,101 A | | 6/1972 | Kloth | |
| 3,983,313 A | * | 9/1976 | Ney et al. | 174/113 R |
| 4,365,856 A | | 12/1982 | Yaegashi et al. | |
| 4,678,251 A | | 7/1987 | Willard | |
| 4,761,811 A | | 8/1988 | Zetena, Jr. | |
| 4,773,867 A | | 9/1988 | Keller et al. | |
| 4,860,343 A | | 8/1989 | Zetena, Jr. | |
| 4,920,642 A | | 5/1990 | Yanai et al. | |
| 4,928,303 A | | 5/1990 | Allin et al. | |
| 4,984,992 A | | 1/1991 | Beamenderfer et al. | |
| 4,995,828 A | | 2/1991 | Goodman et al. | |
| 5,094,623 A | | 3/1992 | Scharf et al. | |
| 5,145,387 A | | 9/1992 | Ichihashi | |
| 5,149,277 A | | 9/1992 | LeMaster | |
| 5,149,915 A | * | 9/1992 | Brunker | 174/113 R |

(List continued on next page.)

FOREIGN PATENT DOCUMENTS

| | | |
|---|---|---|
| EP | 0 276 615 | 12/1987 |
| WO | W/O96/23339 | 8/1996 |
| WO | W/O96/23340 | 8/1996 |

OTHER PUBLICATIONS

Information Internet, CommunicationsWeek Interactive, From the pages of CommWeek, week of Dec. 16, 1996, "Get Wired" by Nick Wreden.

Quarterback, The International Newsweekly of the Contract Furniture Industry, May 4, 1998, Products "Haworth launches "Data Thing"".

*Primary Examiner*—Neil Abrams
(74) *Attorney, Agent, or Firm*—Foley & Lardner

(57) ABSTRACT

A modular communications cable assembly comprises first and second connectors, each having an elongated array of electrical contacts, and high-speed (e.g., data) and low-speed (e.g., voice) twisted wire pairs extending between the first and second connectors and terminated to the electrical contacts. Electrical contacts are skipped (or left empty) between the high-speed wire pairs to reduce cross-talk., but no electrical contacts are skipped between the low-speed wire pairs. An electrically conductive member with pins may be used to electrically couple the skipped contacts together to further reduce cross-talk. In another aspect, a modular communications cable assembly provides a plurality of communication circuits to a cluster of workstations. The cable assembly comprises an upstream connector and at least one downstream connector, with a plurality of high-speed cable segments and at least one low-speed cable segment extending between the upstream and downstream connectors. Each high-speed cable segment contains a set of twisted wire pairs for high-speed communication, and the at least one low-speed cable segment provides a plurality of sets of twisted wire pairs for low-speed communication. Each communication circuit comprises one set of twisted pairs from the high-speed cable segments and one set of twisted pairs from the at least one low-speed cable segment. Colors are used to facilitate the proper joining of cable assemblies, e.g., black connectors are joined to red connectors. A circuit breakout assembly (FIG. 13) is used and includes a body, an in-feed connector and a plurality of breakout connectors for providing communication circuits to a cluster of workstations.

14 Claims, 5 Drawing Sheets

U.S. PATENT DOCUMENTS

| | | | |
|---|---|---|---|
| 5,160,276 | A | 11/1992 | Marsh et al. |
| 5,186,647 | A | 2/1993 | Denkmann et al. |
| 5,224,867 | A | 7/1993 | Ohtsuki et al. |
| 5,226,835 | A | 7/1993 | Baker, III et al. |
| 5,269,708 | A | 12/1993 | DeYoung et al. |
| 5,272,277 | A | 12/1993 | Humbles et al. |
| 5,303,320 | A | 4/1994 | Duffie |
| 5,326,934 | A | 7/1994 | LeMaster et al. |
| 5,340,326 | A | 8/1994 | LeMaster |
| 5,350,324 | A | 9/1994 | Guilbert |
| 5,403,200 | A | 4/1995 | Chen |
| 5,431,584 | A | 7/1995 | Ferry |
| 5,451,714 | A | 9/1995 | Duffie |
| 5,460,545 | A | 10/1995 | Siemon et al. |
| 5,530,435 | A | 6/1996 | Toms et al. |
| 5,538,434 | A | 7/1996 | DelGuidice et al. |
| 5,548,086 | A | 8/1996 | Greenfield et al. |
| 5,586,914 | A | 12/1996 | Foster, Jr. et al. |
| 5,593,317 | A | 1/1997 | Humbles |
| 5,601,447 | A | 2/1997 | Reed et al. |
| 5,618,191 | A | 4/1997 | Chikano et al. |
| 5,634,817 | A | 6/1997 | Siemon et al. |
| 5,672,845 | A | 9/1997 | Greenfield et al. |
| 5,682,301 | A | 10/1997 | Kraft |
| 5,684,469 | A | 11/1997 | Toms et al. |
| 5,719,933 | A | 2/1998 | Welch |
| 5,727,963 | A | 3/1998 | LeMaster |
| 5,743,052 | A | 4/1998 | Mayhall et al. |
| 5,774,979 | A | 7/1998 | Kraft |
| 5,831,211 | A | 11/1998 | Gartung et al. |

* cited by examiner

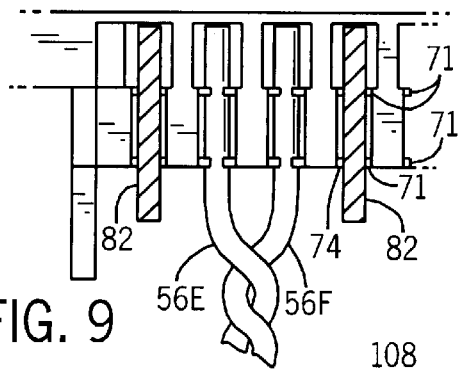
FIG. 9
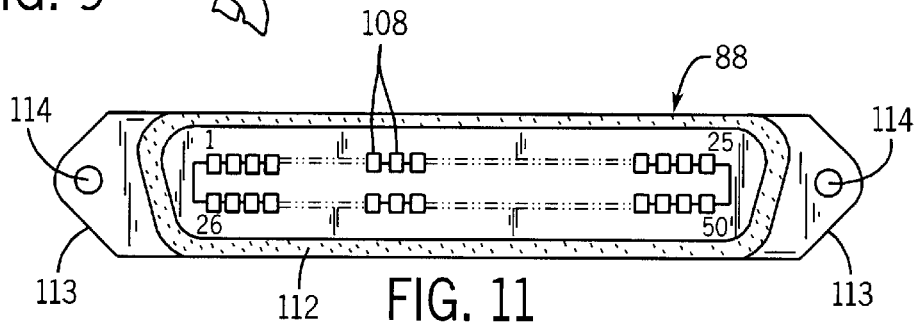
FIG. 11
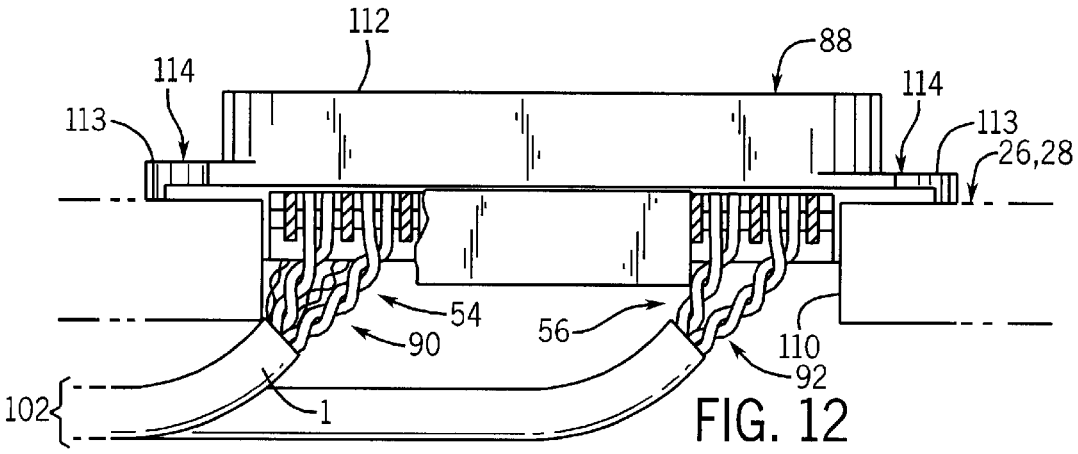
FIG. 12
FIG. 13
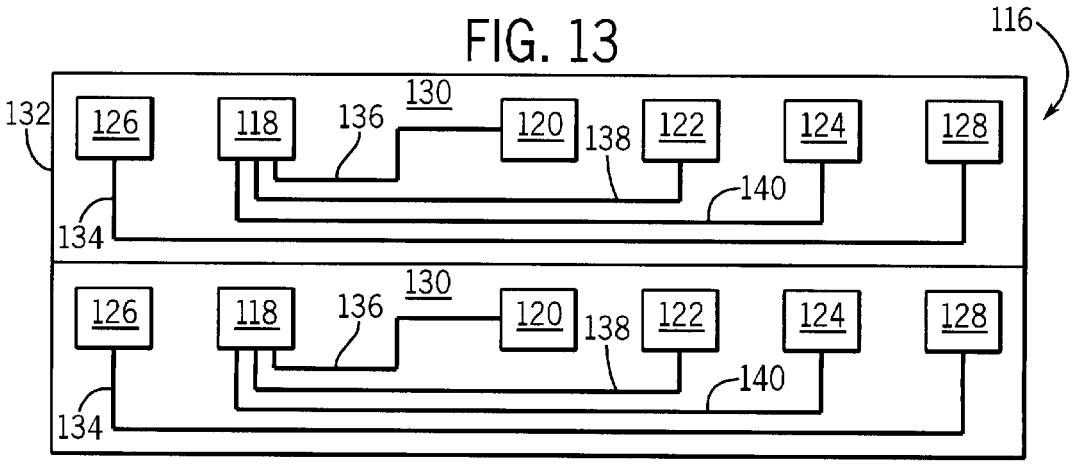

COMMUNICATIONS CABLING SYSTEM WITH TWISTED WIRE PAIRS

FIELD OF THE INVENTION

The present invention relates to telecommunications cabling and devices for transmitting analog and digital electrical signals. In particular, the present invention relates to a modular cable system for providing data and voice communications to a plurality of workstations, which is easy to install and which reliably transmits the data at a high rate.

BACKGROUND OF THE INVENTION

Communications cabling systems transmit information or data in the form of analog or digital electrical signals to and from various offices or workstations. Such cabling systems communicate between a distribution block or a patch panel located in a computer room or telecommunication closet and telecommunication devices located at the workstations, including telephones, facsimile machines and computers. Traditional cabling systems often comprise individual cables that extend uninterrupted from the wiring closet to the user devices (known as a "home run" cabling system). More recently, however, it has become increasingly popular to provide cabling systems with at least one connection point located intermediate the closet and the user devices (known as a "modular" cabling system). A modular cabling system has the advantage in that moves, adds, and changes to the cabling system are substantially simplified in that there is no need to reconfigure the cables all the way back to the wiring closet. Instead, only the cables "downstream" of the intermediate connection point need be reconfigured. Despite the increasing popularity of modular cable systems, however, such modular cabling systems have several drawbacks.

One drawback with existing modular cabling systems is that they can be difficult or confusing for unskilled or inexperienced workers to install properly. This problem can be exacerbated when the modular cabling systems includes what will herein be referred to as Y-cable assemblies, which are another recent development. Each Y-cable assembly includes wiring for multiple offices or workstations and includes three connectors: one upstream connector, one downstream (or pass-thru) connector, and one extractor (or peel-off) connector. The upstream and downstream connectors of the Y-cables can be interconnected to one another to provide a segmented (or serially connected) cabling system that includes all the wiring necessary for the individual offices or workstations. Each Y-cable assembly in the serial chain extracts a unique subset of the wires (or a circuit) to its extractor connector for use by one particular office or workstation. Thus, it is important for the installer to be able easily distinguish the different Y-cables because each can be used only once in the same serial chain.

However, in prior art segmented cabling systems the unique Y-cables have been distinguished only by a part number, usually stamped on one of the connectors. This makes it difficult for the installer to ensure that the system is configured correctly, e.g., the part numbers must be either memorized or written down before comparing one Y-cable with another. Moreover, performing moves, adds or changes on an existing system is further complicated in that such part numbers are located on portions of the connectors that are not visible when the Y-cables are installed. As a result, the installer must either uninstall (at least partially) each of the Y-cables for purposes of identification, or the written records (if they exist) of the wiring scheme must be located and consulted.

Another drawback with existing modular cabling systems is that, although the cables may be capable of communicating at Category 5 or higher performance levels, the connectors often form weak points that limit the overall capabilities of the system. In particular, cross-talk, which is a measure of the amount of signal coupling occurring between different pairs of wires either in a cable or cable-to-cable, can be a problem in connectors when the electrical pins extend close to one another and in parallel. Such cross-talk is a source of interference that degrades the ability of the system to transmit or receive signals, and can become particularly acute at high speeds. It has been discovered, however, that terminating the wire pairs at pin positions so as to leave empty (or unused) pins between the wire pairs can reduce this cross-talk in the connectors, which enables higher data transmission speeds. Nevertheless, with the continuing demand for even faster data transmission rates, there remains a need for cable assemblies that offer reduced cross-talk at even high transmission rates (e.g., 100 MHz to 300 MHz).

Modular segmented cabling systems similar to the type contemplated herein are shown in co-pending and commonly assigned U.S. patent application No. 09/163,886, filed Sep. 30, 1998, now U.S. Pat. No. 6,168,458 ("the '886 application"). The '886 application shows a preferred embodiment of a modular cabling system for providing high speed data communication to a cluster of eight workstations. The segmented cabling system shown in the '886 application includes a unique color coding scheme that enables an installer to properly configure the system by following a few easy to remember rules. Moreover, the '886 application also discloses a device for reducing cross-talk in the connectors.

Workstations conventionally include a variety of equipment besides computers, many of which do not communicate at the same high speeds as modern day computers. For example, telephones, facsimile machines, and modems operate quite well on cabling capable of transmitting signals at lower speeds, such as Category 3. Moreover, most equipment of these types require only one or two wire pairs for communication, rather than four as with computers. Providing transmission capability for such equipment, therefore, either requires that a separate low speed cabling network must be installed or, alternatively, that some of the cabling designed for high speed transmission be used for lower speed transmission.

Accordingly, it would be desirable to provide a single modular cabling system that can be easily installed to provide not only high speed communications for computers, but also low-speed communications for other types of equipment. Moreover, it would also be desirable to provide such a system using integrated connectors that pass both types of signals because this would reduce connector congestion and simplify installation.

SUMMARY OF THE INVENTION

The present invention relates to a modular communications cable assembly comprising a first connector and a second connector, each having an elongated array of electrical contacts. A first plurality of wires arranged in twisted pairs is terminated to selected electrical contacts in each array in a predetermined pattern such that at least one electrical contact remains unterminated between adjacent pairs of the first plurality of wires to reduce cross-talk therebetween. In addition, a second plurality of wires arranged in twisted pairs is terminated to selected electrical contacts in each array in the predetermined pattern such that no electrical contact remains unterminated between at least some adjacent pairs of the second plurality of wires.

The present invention also relates to a modular communications cable assembly for providing a plurality of communication circuits to a cluster of workstations. The cable assembly comprises an upstream connector, at least one downstream connector, a plurality of high-speed cable segments, and at least one low-speed cable segment. Each high-speed cable segment contains a set of twisted wire pairs for high-speed communication and extends between the upstream connector and one of the at least one downstream connectors. The at least one low-speed cable segment extends between the upstream connector and one of the at least one downstream connectors. The at least one low-speed cable segment provides a plurality of sets of twisted wire pairs for low-speed communication. Each circuit comprises one set of twisted wire pairs from the high-speed cable segments and one set of twisted wire pairs from the at least one low-speed cable segment The present invention further relates to a wiring arrangement for providing a plurality of communication circuits to a cluster of workstations. The wiring arrangement includes at least one modular cable assembly having a set of wires extending between a pair of connectors. The set of wires is grouped into disjoint wiring subsets that define the plurality of circuits. The wiring arrangement comprises a breakout assembly for linking the plurality of circuits to the cluster of workstations. The breakout assembly includes a body, an in-feed connector, and a plurality of breakout connectors associated with the in-feed connector. The breakout assembly also includes communications wiring connecting the in-feed connector with the associated breakout connectors such that each circuit is diverted from the in-feed connector to one of the associated breakout connectors.

BRIEF DESCRIPTION OF THE DRAWINGS

FIG. 9 is a sectional view of the first connector and cable assembly of FIG. 3 taken along lines 9—9 in FIG. 8.

FIG. 11 is a front elevational view of a third connector of the second cable assembly of FIG. 3.

FIG. 12 is a top plan view of the third connector of the second cable assembly of FIG. 3.

FIG. 13 is a schematic illustration showing an exemplary circuit breakout assembly that can be used in combination with the cable assemblies of FIG. 3 to further increase the modularity of the cable system.

DETAILED DESCRIPTION OF THE PREFERRED EMBODIMENTS

Figure 1:
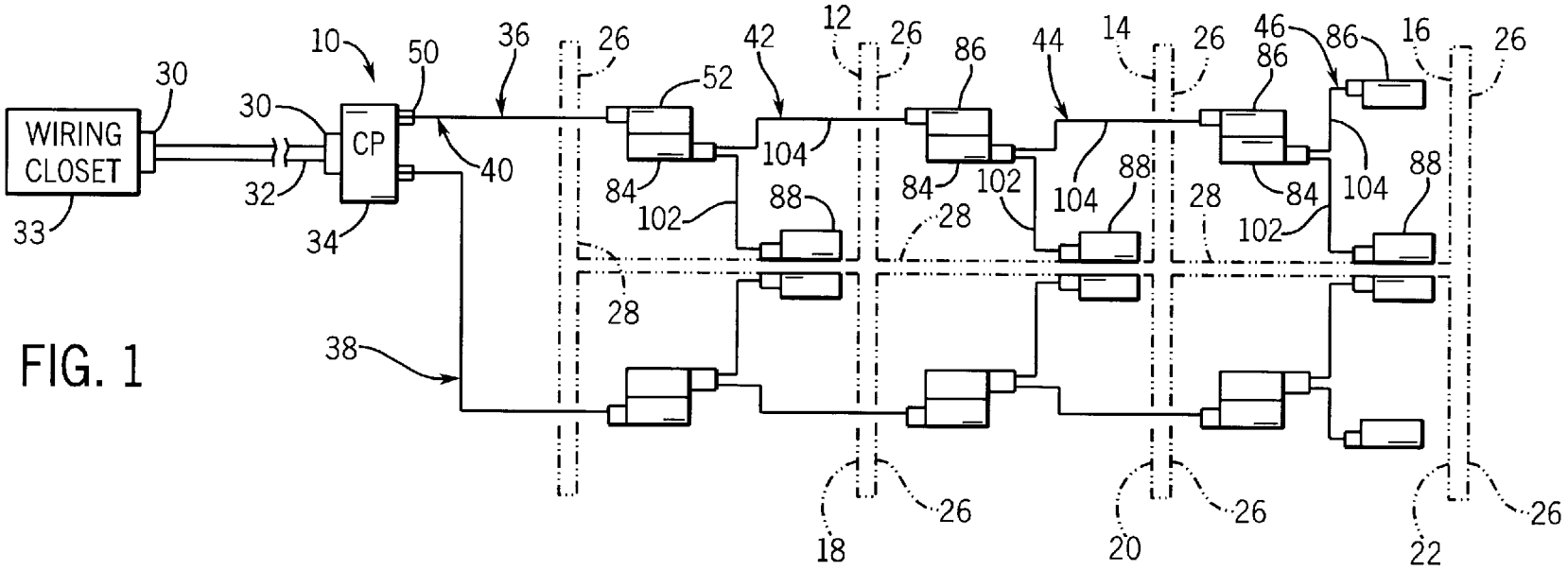
FIG. 1 is a schematic illustration showing an exemplary cable system of the present invention including two cable subsystems installed to provide communications to a cluster of six workstations.

FIG. 1 is a schematic view of an exemplary cabling system 10 installed to provide communications to a cluster of six workstations 12, 14, 16, 18, 20, and 22 divided by partitions 26 and 28. Cabling system 10 includes a horizontal distribution cable (HDC) 32, a consolidation point 34, and cable subsystems 36 and 38. HDC 32 is typically the longest cable in the system and extends from a main distribution interface or other modular closet interface device located in a computer room or wiring closet 33 to consolidation point 34. As conventionally known, the distribution interface represents the demarcation point between the local telephone company or wide area network and the owner of the office distribution network. As is known in the art, HDC 32 may extend through the floor, ceiling, column of the building, or other structure depending on the layout of the building and the locations of wiring closet 33 and consolidation point 34.

HDC 32 is for the most part a conventionally-known cable including electrical leads or wires extending in multiple, i.e., including sets of wires for two or more workstations. HDC 32 differs from a conventional horizontal distribution cable, however, in that it preferably is preterminated at both ends by connectors 30 of the same gender (preferably male). For reasons explained below, both connectors 30 are preferably of the same color, such as black. Because HDC 32 is not gender specific, an installer can pull HDC 32 from closet 33 out to the workstation area (or from the workstation area to the closet) without regard to whether the cable is left handed or right handed. Thus, unlike with gender specific cables, it is impossible for the installer to make a mistake by pulling the wrong end of HDC 32, and thus no effort is ever wasted. Moreover, wasted effort from such a mistake can be substantial because pulling the horizontal distribution cables is often the most labor intensive part of the installation (e.g., an installer might spend several days to pull 50 cables 200 feet).

Consolidation point 34, also known as a subsidiary distribution point, comprises a device for interconnecting wiring extending from closet 33 with wiring extending to the cluster of workstations. More precisely, consolidation point 34 comprises an organizer bracket located between HDC 32 and cable subsystems 36 and 38, and may be situated at a conventional location such as in a ceiling, floor, or building support. Alternatively, consolidation point 34 may be located in one of the partitions 26, 28, in a furniture item, or in an external cabinet located adjacent to or mounted on one of the partitions. Consolidation point 34 eliminates the need to extend individual cable lengths all the way from the distribution interface at closet 33 to each individual workstation. As will be appreciated, cabling system 10 may include as many additional consolidation points as desired.

Cable subsystems 36 and 38 are modular in nature and provide telecommunications from consolidation point 34 to each of the workstations 12–22 in the cluster. Since cable subsystem 36 and 38 are substantially identical to one another, for purposes of brevity, only cable subsystem 36 is discussed hereafter.

Figure 2:
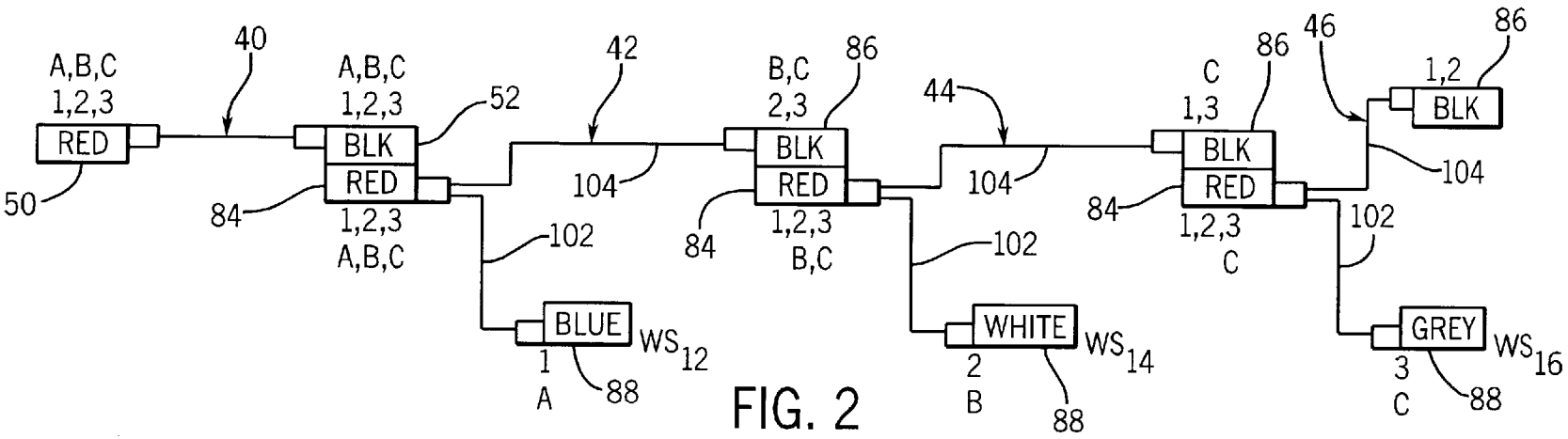
FIG. 2 is a schematic illustration showing a first one of the cable subsystems of FIG. 1 in greater detail.

Referring now to FIG. 2, cable subsystem 36 generally includes a feeder cable 40 (also known as an X-cable assembly) and a plurality of breakout or diversion cable assemblies 42, 44 and 46 (also known as Y-cable assemblies). X-cable 40 is modular in nature and includes a plurality of data wires 54 (see FIG. 4A) and a plurality of voice wires 56 (see FIG. 4B), all of which extend between an upstream connector 50 and a downstream connector 52. For reasons explained below, connectors 50 and 52 are preferably of opposite gender and distinctly colored (preferably a red male connector and a black female connector, respectively). Upstream connector 50 of X-cable 40 is removably connectable to consolidation point 34, and downstream connector 52 is removably connectable to Y-cable 42. Additional or alternatively X-cables 40 could of course be located further downstream, such as between Y-cables 44 and 46, to extend the length of cable subsystem 36.

Figure 3:
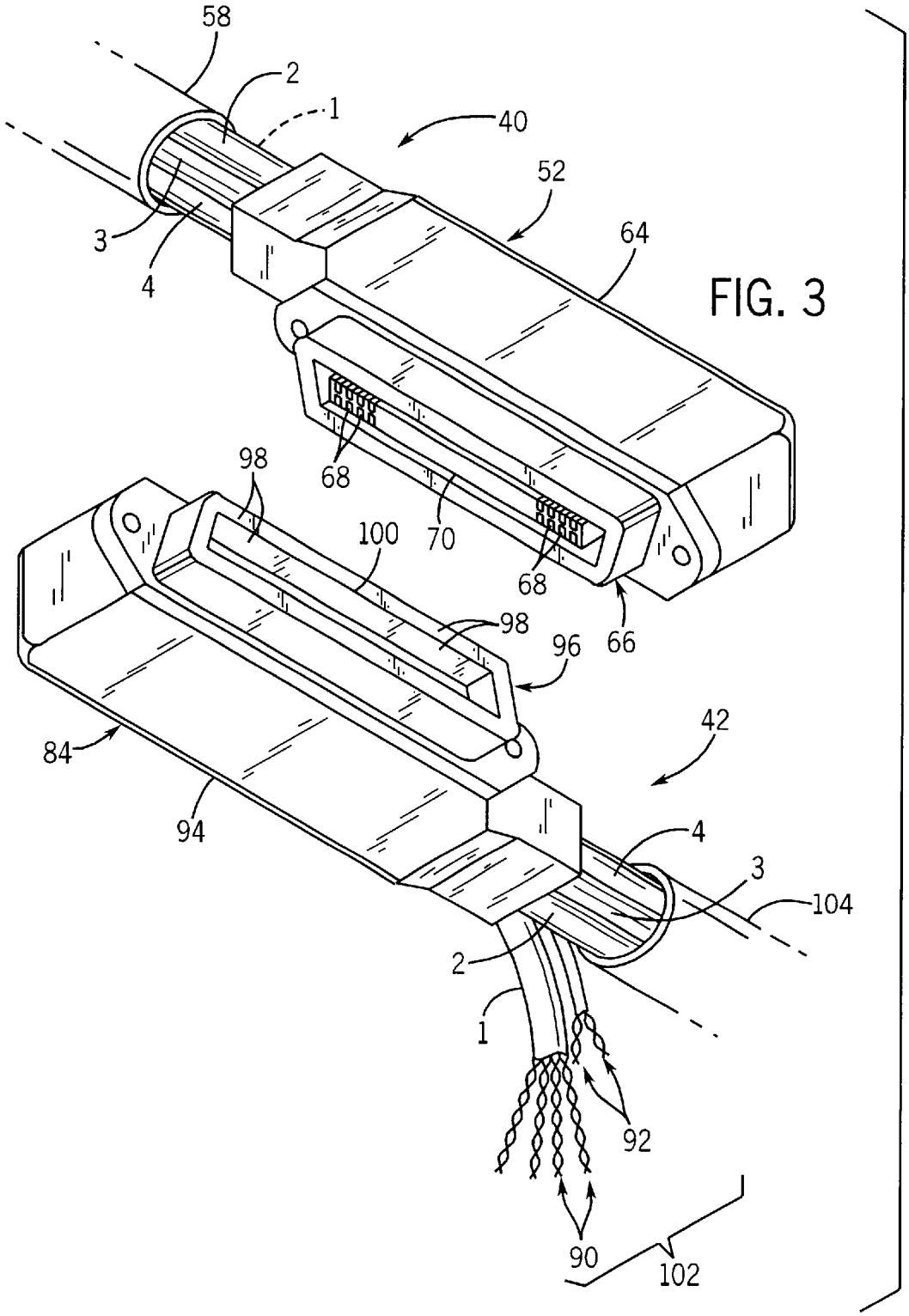
FIG. 3 is a perspective view showing a first type of cable assembly with a first connector and a second type of cable assembly with a second connector, each cable assembly including a plurality of cable segments and the connectors configured to mate with each other.
Figure 4A:
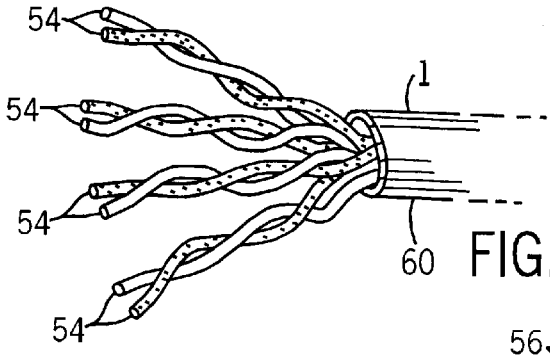
FIG. 4A is a perspective view of a first cable segment of the first cable assembly of FIG. 3 with portions removed for purposes of illustration.
Figure 5:
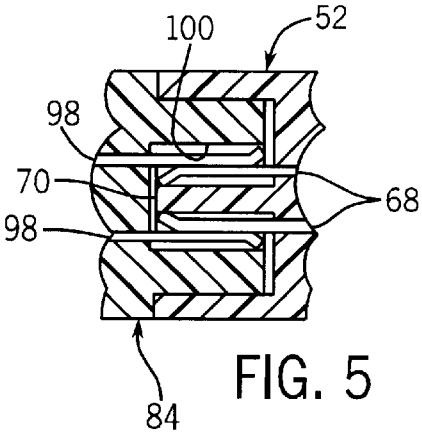
FIG. 5 is a fragmentary sectional view of the first and second connectors of the first and second cable assemblies of FIG. 3 interconnected.

FIGS. 3–5 illustrate portions of X-cable 40 and Y-cable 42. In particular, FIG. 3 illustrates a downstream end portion of X-cable 40 terminated by connector 52, and an upstream portion of Y-cable 42. As can be seen, X-cable 40 includes an optional outer sheath 58 that encases four cable segments 1, 2, 3, 4 (as indicated by the dashed lead-line, cable segment 1 is not visible in FIG. 3). When sheath 58 is present, it preferably comprises a polymeric flame-retardant sheath that is shielded to prevent noise interference with cable segments 1, 2, 3 and 4 from induced voltage.

FIG. 4A illustrates cable segment 1 of X-cable 40 in greater detail, with portions of the segment removed for clarity. As can be seen, cable segment 1 includes eight individually insulated wires 54 that are arranged as four twisted pairs and enclosed within a sheath 60. Sheath 60 may be a polymeric flame-retardant sheath and/or shielded to prevent induced voltage. Cable segments 2 and 3 are substantially identical to cable segment 1. In the preferred embodiment, cable segments 1, 2 and 3 each include wires 54 designed to carry high-speed data signals (e.g., Category 5 or higher)

Figure 4B:
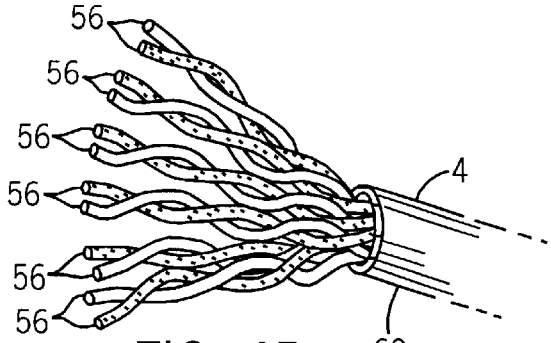
FIG. 4B is a perspective view of a second cable segment of the first cable assembly of FIG. 3 with portions removed for purposes of illustration.

FIG. 4B illustrates cable segment 4 of X-cable 40 in greater detail, with portions of the segment removed for clarity. As can be seen, cable segment 4 includes twelve individually insulated wires 56 that are arranged as six twisted pairs and enclosed within a sheath 62. Sheath 62 may be a polymeric flame-retardant sheath and/or shielded to prevent induced voltage. In the preferred embodiment, cable segment 4 includes wires 56 designed to carry low-speed voice signals (e.g., Category 3 to Category 5). Those skilled in the art will recognize that wires 56 could also carry low-speed data signals. Moreover, it should be clear that the terms "low-speed" and "high-speed" are used in a relative sense. That is, as connector and cabling technology improves and the speeds increase, the high-speed cabling transmission speeds could be, for example, Category 7–9, while the low-speed cabling transmission speeds could be Category 5–6.

Returning to FIG. 3, downstream connector 52 of X-cable 40 comprises a body 64 having a male mating portion 66 that includes a plurality of electrical contacts 68 spaced along opposite side walls of a terminal bar 70. The individual wires 54, 56 of cable segments 1, 2, 3 and 4 are electrically connected (or terminated) to selected electrical contacts 68 of connector 52 in a predetermined pattern designed to reduce cross-talk in the connector, as explained below. Similarly, the individual wires 54, 56 are also terminated to selected electrical contacts at upstream connector 50 of X-cable 40, but in a complimentary or opposite pattern.

Figure 6:
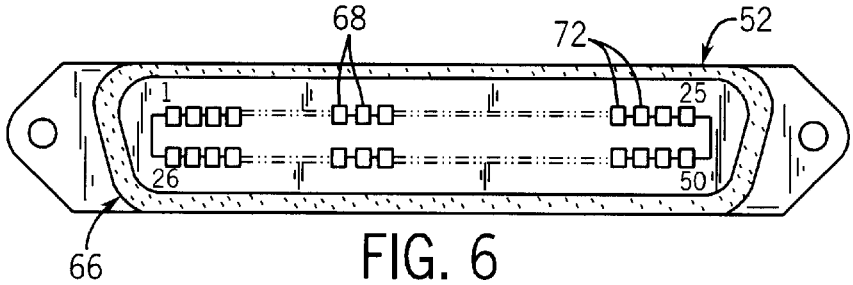
FIG. 6 is a front elevational view of the first connector and cable assembly of FIG. 3.

FIGS. 6–9 illustrate connector 52 and the predetermined termination pattern in greater detail. As best seen in FIG. 6, connector 52 is a conventional 50-pin (25 pair) connector in which electrical contacts 68 are arranged in two parallel rows of 25 pins each, numbered 1–25 in one row and 26–50 in the other row. Pin position 1 is adjacent to pin position 26 at one end of connector 52, and pin position 25 is adjacent to pin position 50 at the other end. Each electrical contact 68 includes a rearwardly facing insulation displacement portion 71 and a forwardly facing contact portion 72. Each insulation displacement portion 71 includes one wire receiving socket 74, which is sized to cut through the wire insulation of one wire 54 or 56 inserted therein to electrically interconnect the wire 54 or 56 with electrical contact 68.

As discussed above, wires 54 and 56 of cable segments 1, 2, 3 and 4 are positioned in specific sockets 74 of connector 52 in a predetermined pattern designed to reduce cross-talk. In particular, wires 54 of each twisted pair in data cable segments 1, 2, and 3 are inserted into adjacent sockets 74 such that at least one socket 74 is skipped (i.e., left empty) between the adjacent twisted pairs. This termination pattern provides extra spacing between the adjacent pairs used for high speed data transmission, which has been found to reduce cross-talk and thus enable higher speeds. As for wires 56 of voice cable segment 4, such extra spacing is not required between the adjacent pairs because the communication speeds of such devices are generally low enough that cross-talk is not a problem. Thus, it is possible to utilize a more dense termination pattern for wires 56, which in turn allows better space utilization in connector 52. For example, in the preferred embodiment which utilizes three data cable segments 1, 2 and 3, a termination pattern that also provides three voice twisted pairs (one for each data cable segment) would be particularly desirable because most workstation users require one data and one voice outlet. This balancing of data and voice capacity can be achieved in a 50-pin connector by terminating all twelve wires 56 (or six pairs) of voice cable segment 4 in adjacent sockets 74 at one end of connector 52 such that no sockets 74 are skipped between voice wires 56. However, one socket 74 is preferably left empty between voice wires 56 and data wires 54 to prevent induced cross-talk.

Although a number of termination patterns could be devised to meet the above requirements, one preferred arrangement will now be described with reference to FIGS. 7–9. As can be seen, data cable segment 1 includes eight wires 54 arranged as four twisted pairs (54A, 54B), (54C, 54D), (54E, 54F), (54G, 54H), which are assigned to specific sockets 74 of connector 52. In particular, wires 54A and 54B are assigned to respective pin positions 2 and 3, wires 54C and 54D are assigned to respective pin positions 5 and 6, wires 54E and 54F are assigned to respective pin positions 27 and 28, and wires 54G and 54H are assigned to respective pin positions 30 and 31. Thus, the four twisted pairs of data cable segment 1 are assigned to pin positions 2–3, 5–6, 27–28, and 30–31, while pin positions 1, 4, 26 and 29 are skipped. Data cable segments 2 and 3 each include eight wires arranged as four twisted pairs, which are assigned to specific sockets 74 of connector 52 in similar termination patterns. In particular, the four twisted pairs of cable segment 2 are assigned to pin positions 8–9, 11–12, 33–34, and 36–67, while pin positions 7, 10, 32 and 35 are skipped.

Similarly, the four twisted pairs of cable segment 3 are assigned to pin positions 14–15, 17–18, 39–40, and 42–43, while pin positions 13, 16, 38 and 41 are skipped.

Figure 8:
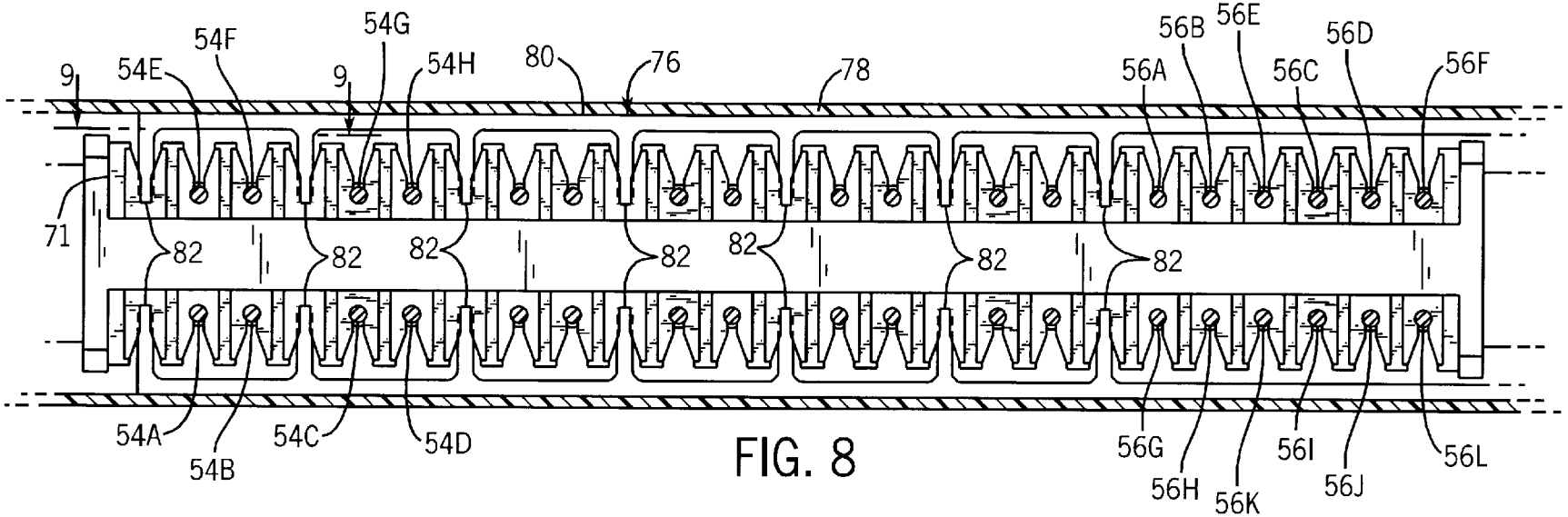
FIG. 8 is a sectional view of the first connector and cable assembly of FIG. 3 taken along lines 8—8 in FIG. 7.

Voice cable segment 4 includes twelve wires 56 arranged as six twisted pairs: three of which pairs (56A, 56B), (56C, 56D), (56E, 56F) are assigned to sockets 74 along the upper row of pins in connector 52 in FIG. 8 and three of which pairs (56G, 56H), (56I, 56J), (56K, 56L) are assigned to sockets 74 along the lower row of pins in connector 52 in FIG. 8. From the combination of FIGS. 8 and 10, it can be seen that four of the six twisted pairs-namely, pairs (56A, 56B), (56C, 56D), (56G, 56H) and (56I, 56J)—are assigned to respective pin positions 20–21, 23–24, 45–46, and 48–49 in a pattern similar to the pattern in which the four twisted pairs in each of the data cable segments 1, 2 and 3 are terminated. However, unlike with those data termination patterns, the remaining pin positions between these four voice pairs, i.e., pin positions 22, 25, 47 and 50, are not skipped. Instead, they are utilized for terminating the remaining two twisted pairs of voice wires 56—i.e., pairs (56E, 56F) and (56K, 56L). In particular, one of the remaining twisted pairs is assigned to pin positions 22 and 25, and the other is assigned to pin positions 47 and 50. As already mentioned, pin positions 19 and 44, i.e., the pin positions between data wires 54 and voice wires 56, are preferably left empty to provide increased spacing and thereby reduce cross-talk.

Terminating four of the six voice twisted pairs in the same pattern as is used for each of the four data twisted pairs provides several advantages. For example, the manufacture of the cable assemblies is simplified because the worker can connect the voice wires in the same pattern as the data wires, with the only difference being the extra step of terminating the two remaining voice wires. More importantly, however, this pattern also facilitates backwards compatibility with other cabling systems of the assignee that pass four high-speed data cable segments through a 50-pin connector. One such system is disclosed in co-pending and commonly assigned U.S. patent application No. 09/163,886, filed Sep. 30, 1998, now U.S. Pat. No. 6,168,458, the entire contents of which are hereby incorporated by reference.

Figure 10:
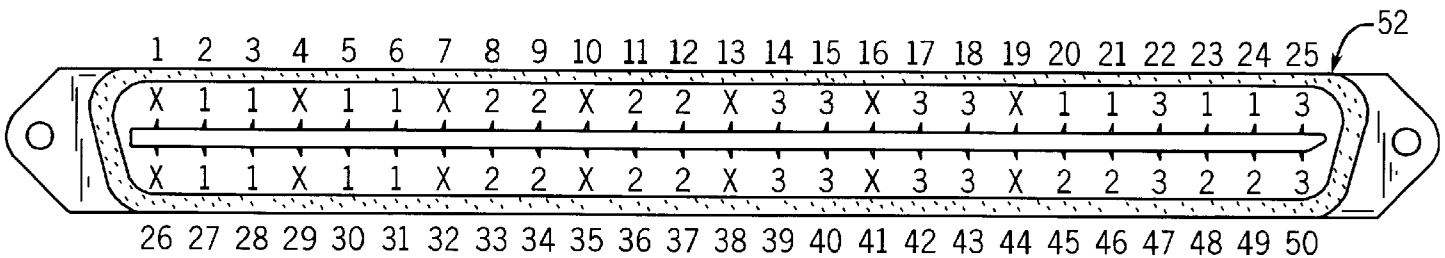
FIG. 10 is a schematic illustration showing a preferred termination pattern for defining three circuits of wires in the first connector and cable assembly of FIG. 3.

FIG. 10 shows a schematic representation of a preferred termination pattern superimposed on connector 52 (illustrated as a male 50-pin connector), and also defines three workstation circuits 1, 2 and 3 comprising disjoint sets of wires (i.e., no wires in common) extending throughout all cable assemblies 40, 42, 44 and 46 in cable subsystem 36. As is conventional, the upper row of pin positions is numbered 1–25 from left to right, and the lower row of pin positions is numbered 26–50 from left to right. The symbol "x" denotes pin positions that are skipped, and the numerals "1", "2" and "3" denote pin positions that are utilized for circuits 1, 2 and 3, respectively. As mentioned above, each circuit 1, 2 and 3 utilizes four twisted pairs of wires 54 for high-speed data transmission and two twisted pairs of wires 56 for low-speed voice communication. In particular, circuit 1 utilizes pin positions 2–3, 5–6, 27–28 and 30–31 for the four data twisted pairs and pin positions 20–21 and 23–24 for the two voice twisted pairs. Circuit 2 utilizes pin positions 8–9, 11–12, 33–34 and 36–37 for the four data twisted pairs and pin positions 45–46 and 48–49 for the two voice twisted pairs. Finally, circuit 3 utilizes pin positions 14–15, 17–18, 39–40 and 42–43 for the four data twisted pairs and pin positions 22, 25 and 47, 50 for the two twisted pairs.

Thus, it can be seen that the two wires 54 of each data twisted pair are terminated to adjacent pin positions in a row with one empty pin between each pair, that wires 56 of the voice twisted pairs are terminated to pin positions without leaving any empty pins, and that one pin is skipped between the data twisted pairs the voice twisted pairs. It should be clear that a number of termination patterns could meet these requirements, and that the above-described and illustrated wire termination pattern is merely one presently preferred pattern.

Figure 7:
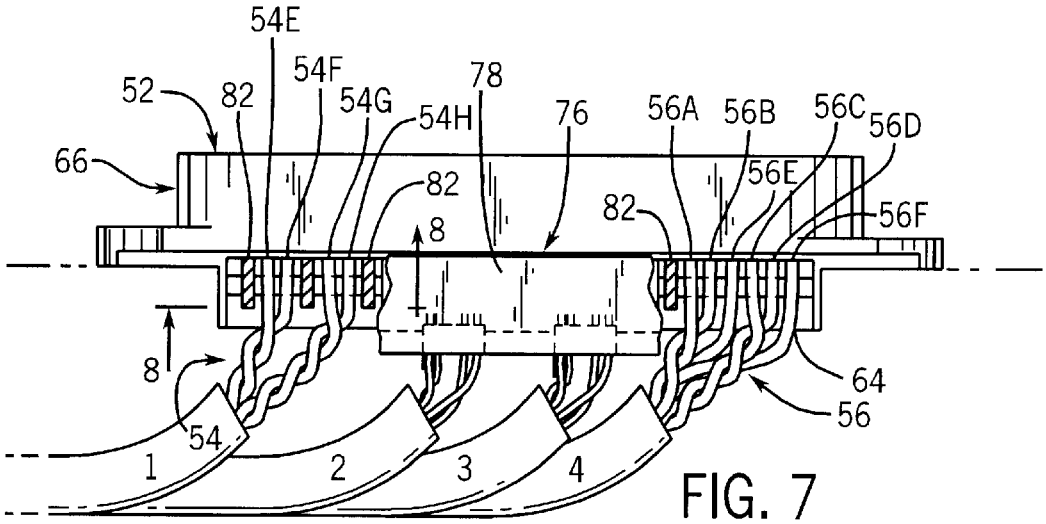
FIG. 7 is a top plan view of the first connector and cable assembly of FIG. 3 with portions of the connector removed for purposes of illustration.

As further shown by FIGS. 7 and 8, connector 52 preferably includes a device 76 for further reducing cross-talk among data wires 54. As illustrated, cross-talk reduction device 76 includes a body 78 and an electrically conductive member 80. Body 78 is preferably made of a plastic, nonconductive material, but it may be formed from a variety of other materials including conductive ones.

Electrically conductive member 80 electrically interconnects empty sockets 74 to each other in connector 52. In the illustrated embodiment, therefore, conductive member 80 electrically interconnects empty sockets 74 corresponding to pin positions 1, 4, 5, 10, 13, 16 and 19 along one row of electrical contacts 68, and pin positions 26, 29, 32, 35, 38, 41 and 44 along the other row. The empty pin positions in the two rows may also be electrically interconnected with each other if desired. As illustrated, conductive member 80 includes a plurality of pins 82 that are located and sized such that pins 82 extend into and become firmly seated in associated sockets 74 when device 76 is installed on connector 52. Cross-talk reduction device 76 could be part of the initial manufacture of connector 52 or, alternatively, it could be retrofitted onto an existing connector 52 and then soldered, glued, or otherwise held in place (e.g., by simple interference or snap fit). Even simpler, cross-talk reduction device 76 could comprise a plurality of short segments of electrical wiring that would be inserted into empty sockets 74 of electrical contacts 68 to interconnect them.

Since electrically conductive member 80 is made of a highly conductive material, such as copper, it absorbs and distributes energy that leaks from the pairs and which would otherwise be transferred directly to an adjacent wire pair. Device 76 also reduces alien cross-talk, which is the tendency of signals in one cable segment to induce signals in adjacent cable segment when connected in series. U.S. patent application No. 09/163,886, now U.S. Pat. No. 6,168,458, which was incorporated by reference above, includes a table that illustrates comparative test results for similar connectors both with and without cross-talk reduction devices. As can be seen from the table, cross-talk reduction device 76 allows electronic signals or data to be transmitted at faster rates than would otherwise be possible. In particular, appropriately configured devices can be used to reduce cross-talk such that connectors designed originally for Cat 5 performance (100 Mbps) can be improved to Cat 6, Cat 7, or even higher.

Although the above-described termination pattern and cross-talk reduction device 76 have been illustrated and described for reducing cross-talk in a 50-pin male connector (i.e., connector 52 in X-cable 40), such cross-talk reducing features are also preferably used in all the other connectors in cable subsystem 36, regardless whether male or female, upstream or downstream, or the number of pins or rows of electrical contacts.

Returning now to FIG. 2, each Y-cable 42, 44 and 46 generally includes an upstream connector 84 (preferably female), a pass-thru connector 86 (preferably male), a peel-off connector 88, and a plurality of data and voice wires 90 and 92, respectively (see FIG. 3). For reasons explained below, it is also preferable for connectors 84 and 86 to be differently colored (preferably red and black, respectively). Preferably, pass-thru and peel-off connectors 86 and 88, respectively, of Y-cables 42, 44 and 46 are all similar in construction to downstream connector 52 of X-cable 40 described above.

As best illustrated in FIG. 3, upstream connector 84 of Y-cable 42 comprises a body 94 having a female mating portion 96, which includes a plurality of electrical contacts 98 spaced along opposed side walls of a slot 100. A portion of electrical contacts 98 of upstream connector 84 are electrically connected to individual wires 90, 92 of cable segments 1, 2, 3 and 4 in a predetermined pattern that is similar to, but opposite, that described above for downstream connector 52 of X-cable 40. This is necessary so that the wires 54, 56 of cable segments 1, 2, 3 and 4 in X-cable 40 are electrically connected to appropriate wires 90, 92 of associated cable segments 1, 2, 3 and 4 in Y-cable 42 when connectors 52 and 84 are interconnected. As best seen in FIG. 5, Y-cable assembly 42 can be serially interconnected with X-cable 40 by inserting terminal bar 70 of downstream connector 52 into slot 100 of upstream connector 84, which causes electrical contacts 68 to firmly engage electrical contacts 98. Y-cables 42, 44 and 46 can be serially interconnected to one another in a similar manner.

Returning again to FIG. 2, each Y-cable 42, 44 and 46 is uniquely configured to divert a unique subset of wires 90, 92 (i.e., circuit 1, 2 or 3) from upstream connector 84 to peel-off connector 88, while the remaining wires 90, 92 continue on from upstream connector 84 to pass-thru connector 86. In particular, Y-cable 42 is configured such that wires 90, 92 of circuit 1 (see FIG. 10) extend through an extraction lead 102 to peel-off connector 88, while wires 90, 92 of circuits 2 and 3 continue on through a main lead 104 to pass-thru connector 86. Y-cable 44 is configured such that wires 90, 92 of circuit 2 (see FIG. 10) extend through extraction lead 102 to peel-off connector 88, while wires 90, 92 of circuits 1 and 3 continue on through main lead 104 to pass-thru connector 86. And Y-cable 44 is configured such that wires 90, 92 of circuit 3 (see FIG. 10) extend through extraction lead 102 to peel-off connector 88, while wires 90, 92 of circuits 1 and 3 continue on through main lead 104 to pass-thru connector 86.

Accordingly, Y-cables 42, 44 and 46 can be serially interconnected to provide integrated data and voice circuits 1, 2 and 3 to a cluster of workstations, with particular circuits 1, 2 and 3 being diverted to individual workstations for use by both high-speed and low-speed telecommunication devices. Moreover, because each Y-cable 42, 44 and 46 includes all three unique subsets 1, 2 and 3 of wires 90, 92, either in main lead 104 or extraction lead 102, the Y-cables 42, 44 and 46 can be connected in any order and still function.

An example will help make this more clear. Referring again to FIG. 2, X-cable 40 can be seen to carry electrical signals A, B and C through respective wire subsets (or circuits) 1, 2 and 3 to and from Y-cable 42. Y-cable 42 diverts circuit 1, and thus signal A, through extraction lead 102 to peel-off connector 88 for use in workstation 12 ($WS_{12}$). Signals B and C, however, continue through main lead 104 via circuits 2 and 3 to pass-thru connector 86, and thus to upstream connector 84 of Y-cable 44. Y-cable 44 in turn diverts circuit 2, and thus signal B, through extraction lead 102 to peel-off connector 88 for use in workstation 14 ($WS_{14}$), while signal C continues through main lead 104 via circuit 3 to pass-thru connector 86, and thus to upstream connector 84 of Y-cable 46. Lastly, Y-cable 46 diverts circuit 3, and thus signal C, to peel-off connector 88 for use in workstation 16 ($WS_{16}$).

As further shown by FIG. 2, each unique Y-cable 42, 44 and 46 includes a unique indicium corresponding to the unique wire subset 1, 2 or 3 included in its extraction lead 102. In a preferred embodiment, the indicium associated with each Y-cable 42, 44 and 46 is a unique color, which preferably is located on each peel-off connector 88 and/or on the outer sheath of extraction lead 102. For example, Y-cable 42, in which wire subset 1 is diverted by extraction lead 102, includes a blue peel-off connector 88 and a blue extraction lead 102. Likewise, peel-off connectors 88 of Y-cables 44 and 46 are white and gray, respectively, to correspond with respective wire subsets 2 and 3 being diverted by extraction leads 102. The unique color indicium is preferably applied to each peel-off connector 88 by molding it from an appropriately colored molding material. Alternatively, peel-off connector 88 may have a colored coating or paint applied thereto, or a colored member (e.g., a sticker) may be adhered to the connector, either during or after initial manufacture.

From the foregoing, it is clear that cable subsystem 36 includes unique color assignments that would enable an installer to easily distinguish the unique Y-cables 42, 44 and 46 from one another, simply by a glance. Thus, even an inexperienced worker can easily install the system or perform moves, adds or changes, in substantially less time and with reduced chance for errors than was possible using the heretofore known modular cabling systems. Moreover, the installer need only remember and follow a few simple rules to properly connect the Y-cables in a properly functioning serial chain: a red connector is always connected to a black connector, and each unique color (e.g., blue, white, gray) can be used only once in the chain. However, Y-cables 42, 44 and 46 may be interconnected in any order. Consequently, this unique color-coding scheme makes installation of a segmented modular cabling system simple and non-threatening.

FIGS. 11 and 12 illustrate peel-off connector 88 of Y-cable 42 in greater detail. As can be seen, connector 88 is similar to downstream connector 52 of X-cable 40, and includes a body 106 and a plurality of electrical contacts 108. Connector 88 is preferably adapted for being installed in a port 110 form in one of the partitions 26, 28 such that a front face 112 of connector 88 remains visually accessible even when installed (see FIG. 12). To secure connector 88 in place, body 106 preferably includes a pair of lateral projections 113 that extend from opposite ends of body 106 and contain screw or bolt holes 114. Body 106 includes a front mating portion of a predetermined gender (preferably male) that is configured for mating with a patch cable (such as described below) having a connector of opposite gender.

In the exemplary embodiment, the unique indicium on each peel-off connector 88 is preferably located on front face 112 and extensions 113. Thus, the installer can easily determine which Y-cables 42, 44 and 46 are currently being used in cable subsystem 36 without having to remove or disturb any of the peel-off connectors 88 from the ports 110. Of course, alternative or additional easily distinguishable unique indicia could be used to achieve this same result. For example, front face 112 of each connector 88 could be provided with a unique surface texture. Unique surface texture indicia would enable the installer to easily identify and distinguish the Y-cables 42, 44 and 46 from one another even when connectors 88 are, for some reason, not visible. For example, surface texture indicia would be highly advantageous when the lighting is poor, or when there are other visual impairments such as furniture or other obstructions that block the installer's view. It should thus be clear that the only requirements for the unique indicia are that they enable easy identification of the various assemblies and remain accessible (e.g., visually or tactilely) even when connectors 88 are installed.

Referring now to FIG. 12, the preferred pattern for terminating the wires 90, 92 of circuits 1, 2 and 3 in peel-off connectors 88 of respective Y-cables 42, 44, and 46 will be explained. In the illustrated embodiment, each extraction lead 102 comprises all four pairs of wires 90 from one of the data cable segments 1, 2, 3 as well as two pairs of wires 92 from voice cable segment 4. However, no matter which circuit 1, 2 or 3 is being diverted to peel-off connector 88, the eight data wires 56 (four pairs) and four voice wires (two pairs) are preferably terminated to identical pin positions in the connector. In particular, the eight data wires 90 (four pairs) are preferably terminated to pin positions in the same manner as explained above for terminating data wires 54 of cable segment 1 in downstream connector 52 of X-cable 40 (see FIGS. 7, 8). That is, the four pairs of data wires 90 of circuit 1 are preferably terminated in pin positions 2–3, 5–6, 27–28, and 30–31. As to the four voice wires 92, one pair is preferably terminated in pin positions 20–21, and the other pair is preferably terminated in pin positions 23–24.

Terminating data and voice wires 90, 92 of all three circuits 1, 2 and 3 to the same pin positions in peel-off connector 88 for all three Y-cables 42, 44 and 46 provides a number of advantages. Most importantly, the same type of patch cable can be used to carry the signals from peel-off connector 88 to the user devices, no matter which Y-cable 42, 44 or 46 is being used. Although not illustrated, such a patch cable would have an upstream connector configured to releasibly mate with peel-off connector 88 and one or more downstream connectors configured to releasibly mate with the user devices. For example, the downstream connector(s) of the patch cable could comprise a single 50-pin connector or, alternatively, one four-pair RJ45 data plug for a computer and one two-pair RJ11 plug for a telephone, modem or fax. Another possibility is that the patch cable could be provided with three downstream connectors comprising a four-pair RJ45 plug for the computer, a one-pair RJ11 plug for the telephone, and a one-pair RJ11 plug for the modem. It will be recognized that other combinations are possible, such as breaking the one four-pair data into two separate two-pairs.

FIG. 13 shows a schematic representation of a breakout box 116 that can be used in combination with the above-described cabling system 10 to further increase its modularity. In the illustrated embodiment, breakout box 116 comprises two in-feed connectors 118 and six associated breakout connectors 120, 122 and 124. In addition, breakout box 116 includes two input connectors 126, each of which is associated with an output connector 128. All connectors 118–128 are preferably mounted on a front face 130 of a housing 132 or, alternatively, on a plate, rack, or bracket. Preferably, housing 132 is generally rectangular in shape and configured for mounting inside one of the partitions 26, 28.

Preferably, connectors 126, 128 provide a straight passthrough capability, while connectors 118–124 provide a circuit breakout capability. The circuit passthrough capability (i.e., a one-to-one coupling) is provided by internal cabling 134, which electrically couples each input connector 126 to one associated output connector 128. In particular, internal cabling 134 is terminated to input and output connectors 126 and 128, respectively, in the same pattern as discussed above for the upstream and downstream connectors 50 and 52, respectively, of X-cable 40.

The circuit breakout capability (i.e., a one-to-three coupling) is provided by internal cabling 136, 138 and 140, which electrically couples each in-feed connector 118 to three associated breakout connectors 120, 122 and 124, respectively. Internal cabling 136, 138 and 140 is terminated to in-feed connector 118 in the same pattern as described above for upstream connector 84 of Y-cables 42, 44 and 46, and also terminated to breakout connectors 120, 122 and 124 in the same pattern as described above for peel-off connectors 88 of Y-cables 42, 44 and 46. Thus, the three circuits 1, 2 and 3 present at in-feed connector 118 are diverted such that circuit 1 goes through cabling 136 to breakout connector 120, circuit 2 goes through cabling 138 to breakout connector 120, and circuit 3 goes through cabling 138 to breakout connector 124.

One of skill in the art will recognize that breakout box 116 could be utilized either in place of, or in addition to, consolidation point 34 to increase the modularity of cabling system 10. For example, breakout box 116 could be installed in one partition wall 26, 28 such that front face 130 is exposed in a workstation for use by a single heavy-duty user (e.g., a user requiring three data outlets and three voice outlets). This arrangement would allow the heavy-duty user access to all three circuits 1, 2 and 3 at one convenient location, without having to breakout each of the circuits 1, 2 and 3 by means of three serially connected Y-cables 42, 44 and 46.

Breakout box 116 could also be useful in other situations, such as illustrated by the following example. Assume that breakout box 116 is initially installed in partition panel 26 forming the left side of workstation 12 in FIG. 1, and that users at workstations 16 and 22 currently are provided one data and one voice outlet, and three data and three voice outlets, respectively. This capability could be initially provided through breakout box 116, for example, by running an X-cable 40 from breakout connector 120 of breakout box 116 to an outlet at workstation 16, and by running another X-cable 40 from output connector 128 to workstation 22. If, at a later date, the users in workstations 16 and 22 needed to switch locations, each user could be provided with the required communication capability simply by swapping the upstream connectors of each X-cable 40. Such a switch could not be just as easily made at consolidation point 34, however, because swapping X-cables or Y-cables at that point would effect additional workstations not involved in the switch.

Although the present invention has been described with reference to preferred embodiments, workers skilled in the art will recognize that changes may be made in form and detail without departing from the spirit and scope of the invention. For example, although each cable assembly is illustrated and described as using 50-pin connectors each having two rows of 25 pins (i.e., a two dimensional array), connectors having electrical contacts in other arrangements could be used, e.g., a linear array (i.e., one dimensional), an M×N matrix, or even a circular array of electrical contacts. Moreover, connectors having increased pin capacity (e.g., 64-pin connectors each having two rows of 32 pins) could be used to allow the construction of Y-cable assemblies that extract more than one circuit to the peel-off connectors. These and other modifications are considered to form part of the invention, which is limited only by the scope of the claims which follow.

What is claimed is:

1. A modular communications cable assembly, comprising:

a first connector and a second connector, each connector having a rectangular array of electrical contacts including a first contiguous section of high-speed pins adjacent one end of the array and a second contiguous section of low-speed pins adjacent an opposite end of the array;

a plurality of high-speed wires arranged as twisted pairs and extending between the first and second connectors, the high-speed wires being terminated to selected high-speed pins such that the wires of each twisted pair are terminated to adjacent high-speed pins and at least one high-speed pin is left empty between each adjacent pair of high-speed wire pairs; and a plurality of low-speed wires arranged as twisted pairs and extending between the first and second connectors, the low-speed wire being terminated to the low-speed pins such that no low-speed pins are left empty between the low-speed wire pairs.

2. The cable assembly of claim 1, wherein the plurality of high-speed wires are used for high-speed communication and the plurality of low-speed wires are used for low-speed communication.

3. The cable assembly of claim 1, wherein the plurality of high-speed wires are used for transmitting data signals and the plurality of low-speed wires are used for transmitting voice signals.

4. The cable assembly of claim 1, wherein the plurality of high-speed wires and the plurality of low-speed wires are contained within separate cable segments.

5. The cable assembly of claim 4, wherein the plurality of high-speed wires are contained within three separate cable segments, each cable segment including eight wires arranged as four twisted pairs and being encased by a separate protective sheath.

6. The cable assembly of claim 4, wherein the plurality of low-speed wires are contained within a single cable segment encased by a protective sheath, which includes twelve wires arranged as six twisted pairs.

7. The cable assembly of claim 1, wherein at least one electrical contact is left empty between the first and second contiguous sections of electrical contacts to reduce cross-talk therebetween.

8. The cable assembly of claim 1, wherein each rectangular array includes two parallel rows of electrical contacts.

9. The cable assembly of claim 8, wherein each row of electrical contacts includes 25 pins.

10. The cable assembly of claim 1, further comprising:

a third connector having a rectangular array of electrical contacts including a section of high-speed pins and a section of low-speed pins;

a plurality of high-speed extraction wires arranged in twisted pairs and terminated to selected high-speed pins in the first and third connectors such that at least one high-speed pin is left empty between adjacent pairs of the high-speed extraction wires to reduce cross-talk therebetween; and a plurality of low-speed extraction wires arranged in at least one twisted pair and terminated to selected low-speed pins in the first and third connectors.

11. The cable assembly of claim 10, wherein the plurality of high-speed extraction wires are used for data communication and the plurality of low-speed extraction wires are used for voice communication.

12. A modular communications cable assembly, comprising:

a first plurality of high-speed twisted wire pairs and a second plurality of low-speed twisted wire pairs, the first and second pluralities of twisted wire pairs extending between a pair of electrical connectors, each of the electrical connectors including a rectangular array of electrical contacts, the first plurality of high-speed twisted wire pairs being terminated to selected electrical contacts in a first contiguous region of electrical contacts adjacent one end of the rectangular array in each connector such that at least one electrical contact is left empty in the array between adjacent high-speed twisted wire pairs, and the second plurality of low-speed twisted wire pairs being terminated to electrical contacts in a second contiguous region of electrical contacts adjacent an opposite end of the rectangular array in each connector such that no electrical contacts are left empty in the array between adjacent low-speed twisted wire pairs.

13. The cable assembly of claim 12, wherein at least one electrical contact is left empty between the first and second contiguous regions of electrical contacts to reduce cross-talk therebetween.

14. The cable assembly of claim 12, further comprising a third electrical connector having a third rectangular array of electrical contacts and a plurality of high-speed and low-speed wires extending between one of the connectors from the pair of electrical connectors and the third connector, the high-speed and low-speed wires being terminated to electrical contacts in the third rectangular array in an identical pattern as used for terminating the high-speed and low-speed wires in the one of the connectors.

* * * * *